United States Patent [19]

Kobayashi et al.

[11] Patent Number: 4,802,286

[45] Date of Patent: Feb. 7, 1989

[54] METHOD AND APPARATUS FOR FREEZE DRYING

[75] Inventors: Masakazu Kobayashi, Tokyo; Konomi Harashima, Yokohama; Hiroichi Ariyama, Iwatsuki, all of Japan

[73] Assignee: Kyowa Vacuum Engineering, Ltd., Tokyo, Japan

[21] Appl. No.: 154,151

[22] Filed: Feb. 9, 1988

[51] Int. Cl.[4] ..... F28B 5/04

[52] U.S. Cl. ..... 34/15; 34/5; 34/92

[58] Field of Search ..... 34/5, 15, 92, 17

[56] References Cited

U.S. PATENT DOCUMENTS 3,264,745 8/1966 Seffinga ..... 34/5 X 3,281,956 11/1966 Mason ..... 34/5 X

*Primary Examiner*—Henry A. Bennet

*Attorney, Agent, or Firm*—Fulbright & Jaworski

[57] ABSTRACT

In the freeze drying method of the present invention, a predetermined amount of water is poured on the refrigerating/heating surface provided in the drying chamber, which surface is cooled to a temperature below 0° C., so that an ice film is formed on the refrigerating/heating surface. After that, while the thus formed ice film is kept at a temperature below 0° C., a liquid material is supplied to the surface of the ice film so that a frozen layer of the liquid material is formed on the surface of the ice film. Under such circumstances, a vacuum is produced in the drying chamber to conduct the freeze drying operation of the frozen material in a vacuum environment.

6 Claims, 6 Drawing Sheets

METHOD AND APPARATUS FOR FREEZE DRYING

BACKGROUND OF THE INVENTION

1. Field of the Invention:

The present invention relates to freeze drying method and apparatus suitable for the treatment of material such as liquid solutions, emulsions, suspensions of solids in liquids, slurries and the like.

2. Description of the Prior Art:

In a conventional freeze drying method for the material to be dried, there is employed a tray/shelf system. In this system, the material having been frozen and received in containers such as trays and the like is disposed on or between shelves in a vacuum chamber, from which shelves a certain amount of heat is supplied to such frozen material so that sublimation of at least one of constituents of the frozen material occurs. After completion of such sublimation, clean air or nitrogen gas is introduced into the vacuum chamber. Then, the material having been dried through such sublimation is taken out of the vacuum chamber together with the containers.

In such conventional method, a mass-produced product, for example, a coffee extract liquid is first concentrated and then frozen. The thus frozen coffee extract is granulated to have a particle-size of from 1 to 3 mm. After that, the trays are filled with the thus granulated coffee extract. As for another mass-produced product, for example, a drug liquid, the bulk drying thereof is hitherto employed. In such bulk drying, the drug liquid is pressed out in a fine spray directed to a liquid of "Freon 12" which is one of trade names of dichlorodifluoromethane ($CCl_2F_2$) so as to form a fine particle-size frozen matter with which the trays are filled. The above-mentioned conventional method will be hereinafter referred to as the prior art 1.

In another conventional freeze drying method for the liquid material to be dried, the material is first poured into the trays and then disposed on cooling shelves or disposed in a freezing chamber so that the material is frozen as is in cases of most bulk drying operations of the drugs and a few foods. Such another conventional freeze drying method will be hereinafter referred to as the prior art 2.

In any of the prior arts 1 and 2, the material to be dried is first spread on plate-like trays widely and thinly, and then subjected to a preliminary freezing operation and a freeze drying operation. After that, the trays are upset to collect the product. Consequently, in any case, it is necessary to handle a plurality of the trays each of which has a wide surface area, in a wide space by means of a complex handling mechanism or at the expense of considerable labors. In case that the material to be dried must be treated in a high-level hygienic environment, such treatment must be conducted in a bio-clean room.

Especially, in the prior art 2 in which the liquid material is first poured into the trays and then frozen in the trays, the material frozen in the trays can not be separated from the trays by simply upsetting the trays. Consequently, in this case, it is necessary to scrape the frozen material off the trays manually or by means of an automatic scraping mechanism. Such manual or automatic scraping operation of the material frozen in the trays makes the process of the prior art 2 complex.

These are disadvantages inherent in the prior arts 1 and 2.

In order to eliminate these disadvantages inherent in the prior arts 1 and 2 or the tray/shelf system, there has been provided another conventional freeze drying method as shown in U.S. Pat. Nos. 3,281,956 (prior art 3) and 3,264,745 (prior art 4), in which: a space defined between upright cylinders is filled with the liquid material being dried, and then the surfaces of such cylinders are cooled to form a desired-thickness frozen layer of the liquid material on each of the surfaces of the cylinders. After completion of formation of such frozen layer of the liquid material, the remaining part of the liquid material is removed from the space defined between the cylinders. After that, the frozen layer of the material is subjected to a vacuum environment while heated through the surfaces of the cylinders to obtain from the surfaces the heat required for sublimation, so that sublimation of at least one of constituents of the materials occurs. After completion of such sublimation, the layers of the material dried on the surfaces of the cylinders through such sublimation are scraped from the surfaces of the cylinders and collected by a product receiver disposed below the cylinders. The conventional method disclosed in the above U.S. Patents will be hereinafter referred to as the prior art 3. More particularly, in the prior art 3, a heat-transfer medium is circulated through the cylinders so that the liquid material received in the space defined between these cylinders are frozen in positions adjacent to the surfaces of the cylinders to form the desired-thickness frozen layers of the material in such positions. Then, the remaining part of the liquid material still not frozen in the space is removed from the space, and thereafter the frozen layers of the material is subjected to the vacuum environment while gradually heated by means of the heat-transfer medium circulated in the cylinders. The thus obtained product having been dried on the surfaces of the cylinders are scraped from the surfaces of the cylinders by means of a scraper which rests at a position above the cylinders and is driven downward by a threaded rod in such scraping operation. The thus scraped product or dried material is collected by the product receiver.

As described above, in the prior art 3, the layers of material frozen on the surfaces of the cylinders adhere to the surfaces of the cylinders. Consequently, in order to separate the frozen layers of the material from the cylinders, in the prior art 3, there is employed a scraping mechanism comprising a disk-like scraper having a plurality of circular holes each of which has a diameter slightly larger than an outer diameter of each of the cylinders. In the scraping operation of the frozen material or product, the cylinders pass through the circular holes of the disk-like scraper in a sliding manner so as to scrape the product off the surfaces of the cylinders. Consequently, due to clearances between the circular holes of the scraper and the cylinders, thin layers of the product or frozen material remain on the surfaces of the cylinders, while a metal powder is produced due to a slidable contact established between the surfaces of the cylinders and the scraper, both of which are made of metal. These are disadvantages inherent in the prior art 3.

On the other hand, further another conventional method for freeze drying is disclosed in the prior art 4, in which: a heat-transfer medium for the cooling purpose is circulated through an outer space defined between a plurality of upright cylinders filled with the material being dried, so that a frozen layer of the material is formed on an inner surface of each of the cylinders in contrast with the prior art 3 in which the frozen layer of the material is formed on an outer surface of each of the cylinders. In the prior art 4, there is described that: any scraping mechanism is not employed, and, therefore, in order to facilitate separation of the product or dried material from the inner surfaces of the cylinders, any of the cylinders must be straight in shape and must be free from any deformation even when the temperatures of the cylinders vary.

In the prior art 4, it is described that the product dried on the inner surfaces of the cylinders can be easily separated from the inner surfaces of the cylinders, and therefore any scraping mechanism is not employed. In general, the frozen material is slightly contracted when dried, so as to facilitate separation of the thus dried material from the inner surfaces of the cylinders. However, in most cases, depending on the properties of the material being dried and conditions of the freezing and drying operations, the material having been received in the cylinders in a liquid state and then frozen therein tends to adhere to the inner surfaces of the cylinders except that the material is an extremely dilute solution. As a result, it is not possible to completely separate the dried material from the inner surfaces of the vertical cylinders, and, therefore, a part of the dried material rests on the inner surfaces of the cylinders. This is a defect inherent in the prior art 4.

In any of the prior arts 3 and 4, such remaining part of the dried material resting on the surfaces of the cylinders is subjected to the following cycle of the freeze drying operation of the liquid material, and thereafter repeatedly subjected to the further following cycles in the same manner. If the liquid material to be received in the cylinders during the next cycle of the operation is heated and the surfaces of the cylinders carrying the remaining part of the dried material are also heated, it is possible to dissolve the remaining part of the dried material adhering to the surface of the cylinders so as to remove the same from the surfaces of the cylinders. However, in any of the prior arts 3 and 4, heating of the liquid material deteriorates the quality of the product. In this connection, in the following cycle of the freeze drying operation, in case that the cylinders are kept at a temperature below 0° C. at their surfaces while filled with the liquid material having a temperature of approximately 0° C., the remaining part of the dried material formed on the surfaces of the cylinders during the previous cycle of the freeze drying operation remains as it is in the following cycle of the operation. The more the material is concentrated the more the material adheres to the surfaces of the cylinders. This is another defect inherent in the prior arts 3 and 4.

SUMMARY OF THE INVENTION

It is an object of the present invention to resolve the above problems inherent in the prior arts by providing a method for freeze-drying a material being dried comprising the steps of: feeding directly said material to a refrigerating/heating surface provided in a drying chamber of a vacuum-type freeze drying apparatus; and conducting a freeze drying operation of said material, while said material is prevented from adhering to said refrigerating/heating surface so as to be easily separated from said refrigerating/heating surface after completion of said freeze drying operation of said material.

According to the present invention, the object of the present invention is accomplished as follows:

At first, water is poured on the refrigerating/heating surface provided in the drying chamber of the vacuum-type freeze drying apparatus, while the refrigerating-/heating surface is cooled to a temperature below 0° C. to form an ice film thereon. After completion of formation of the ice film, the refrigerating/heating surface is kept at a temperature sufficiently below 0° C. Under such conditions, a plate-like material or a liquid material is disposed on the ice film to permit such material to freeze on the ice film. After that, a vacuum is produced in the drying chamber so that the thus frozen layer of the material and the ice film are freeze-dried under a vacuum environment. Namely, according to the method of the present invention, the frozen layer of the material to be dried is spaced apart from the refrigerating/heating surface through the ice film having been directly formed on refrigerating/heating surface in the drying chamber of the vacuum-type freeze drying apparatus. During the freeze drying operation, the ice film is subjected to sublimation together with at least one of constituents of the material being dried so as to be removed from the refrigerating/heating surface, and, therefore, the thus dried material is spaced apart from the refrigerating/heating surface through the void or clearance left by the ice film after completion of such sublimation. Such void or clearance makes it possible to separate the dried material or product from the refrigerating/heating surface under the influence of gravity or a slight external force so as to facilitate collection of the dried material or product. Consequently, according to the method of the present invention, it is possible to completely remove the dried material from the refrigerating/heating surface, and collect the product in a perfect manner.

It is another object of the present invention to resolve the problems inherent in the prior arts 3 and 4 by providing a freeze drying apparatus which enables the user to completely separate a material having been frozen on a surface of tubular means and dried thereon from the surface of the tubular means without using any scraping means so as to prevent any part of the dried material from remaining on the surface of the tubular means.

Namely, according to the present invention, the above another object of the present invention is accomplished by providing the freeze drying apparatus comprising: a drying chamber in which a normal-level vacuum is produced; a refrigerating/heating member provided in said drying chamber, said refrigerating/heating member being provided with an inner peripheral surface and an outer peripheral surface, one of said peripheral surfaces constituting a refrigerating/heating surface for a material to be dried; a heat-transfer medium supplying member for supplying a heat-transfer medium to the other peripheral surface of said refrigerating-/heating member; a water supplying/removing member for uniformly supply water onto said refrigerating/heating surface of said refrigerating/heating member; a supplying/removing member for supplying/removing said material to/from an ice film formed on said refrigerating/heating surface of said refrigerating/heating member; and a door means disposed in a lower-end portion of said drying chamber. Namely, in the freeze drying apparatus of the present invention, the refrigerating/heating surface of the refrigerating/heating member is first cooled by the heat-transfer medium fed to the interior of the refrigerating/heating member, and then water is supplied to the thus cooled refrigerating-/heating surface of the refrigerating/heating member to form an ice film thereon. After that, the liquid material is supplied to the thus formed ice film to form a frozen layer of the liquid material thereon. After completion of formation of such frozen layer of the material on the ice film, the freeze-drying operation of the material is conducted in the drying chamber so that sublimation of at least one of constituents of the material occurs together with sublimation of the ice film. As a result, a void or clearance is left in a position between the frozen layer of the material and the refrigerating/heating surface of the refrigerating/heating member by the ice film having been eliminated through such sublimation. Such void or clearance makes it possible that the frozen layer of the material having been dried is easily separated from the refrigerating/heating surface of the refrigerating/heating member, and, therefore, makes it possible to collect the dried material or product in a very easy manner.

DESCRIPTION OF THE PREFERRED EMBODIMENTS

Figure 1:
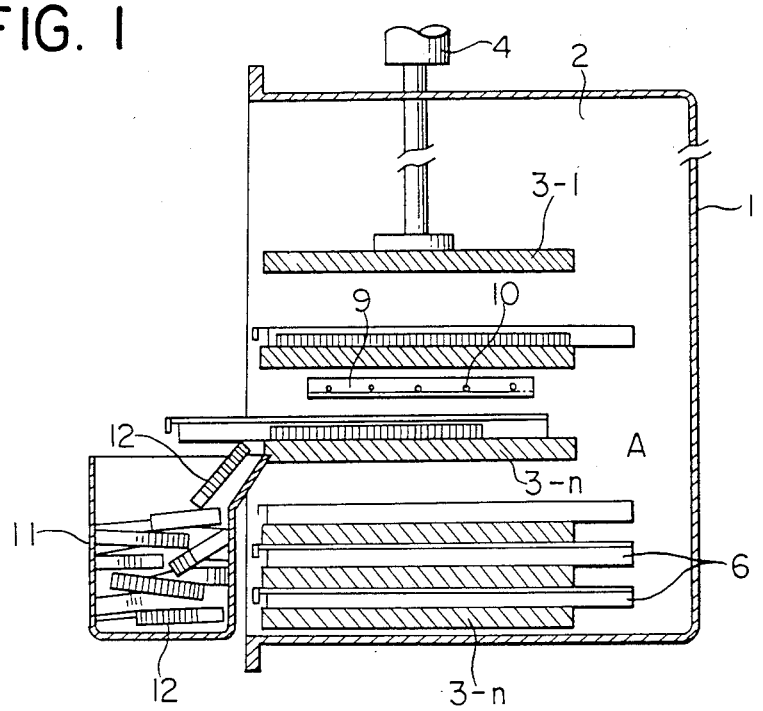
FIG. 1 is a partially broken longitudinal sectional view of a first embodiment of the freeze-drying apparatus of the present invention.
Figure 2:
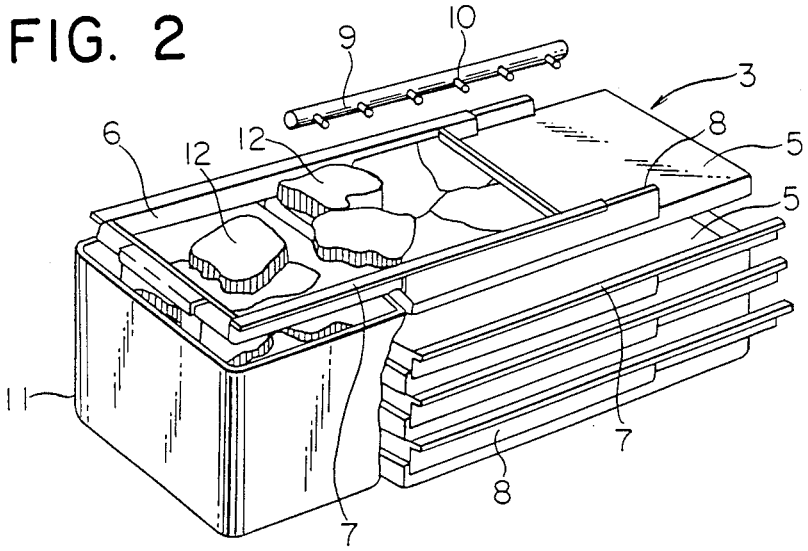
FIG. 2 is a partially broken perspective view of the first embodiment of the freeze-drying apparatus of the present invention shown in FIG. 1.

In a first embodiment of the present invention as shown in FIGS. 1 and 2, the reference numeral 1 denotes a casing in which is defined a drying chamber 2 in which a plurality of horizontal shelf boards 3 are stacked into a vertical pile. As for the reference number 3, it varies from the 3-1 to the 3-n, and the reference numeral 3-1 denotes the uppermost shelf board, while the reference numeral 3-n denotes the n'th shelf board as counted from the uppermost one 3-1. In the first embodiment of the present invention, the whole number of the shelf boards 3 employed therein is three. Each of the shelf boards 3 is provided with a pipeline through which a heat-transfer medium or refrigerant passes. A surface of the shelf board 3 constitutes a refrigerating-/heating surface 5.

These shelf boards 3 are coupled with each other through a vertically extensible coupling mechanism (not shown) disclosed in Japanese Utility Model Laid-Open No. 54-139364 which belongs to the applicant of the present invention. Among the shelf boards 3, the uppermost one 3-1 is coupled with a driving member 4 such as a hydraulic power cylinder mounted on the casing 1. When the uppermost shelf board 3-1 is moved upward to its uppermost position by the driving member 4 as shown in an upper half of the casing 1 shown in FIG. 1, the three shelf boards 3 are spaced apart from each other at predetermined intervals while kept horizontal. On the other hand, when the uppermost shelf board 3-1 is moved downward to its lowermost position by the driving member 4 as shown in a lower half of the casing 1 shown in FIG. 1, the three shelf boards 3 are stacked into a vertical pile. In a front portion of the casing 1 is provided a suitable door means (not shown).

A frame 6 having a square shape or lattice shape provided with a bottom edge is mounted on each of the shelf boards 3 except the uppermost one 3-1 so as to be brought into a close contact with the refrigerating-/heating surface 5 of each of the shelf board 3 at its bottom edge mentioned above. As shown in FIG. 2, the frame 6 is provided with a guide flange 7 in each of its opposite sides. The guide flange 7 projects laterally outwardly from each of the opposite sides of the frame 6 so as to be slidably mounted on a guide rail 8 disposed in the opposite sides of each of the shelf boards 3. Consequently, the frame 6 can be slidably moved back and forth along the guide rails 8.

When the uppermost shelf board 3-1 is moved upward to its uppermost position to permit the lowermost shelf board 3-n to reach a position "A" as shown in FIG. 1, water is poured into the frame 6 mounted on the lowermost shelf boards 3-n from a water-supply member 9 which is provided in opposite side walls of the casing 1 at positions permitting the water-supply member 9 to pour water into such frame 6 mounted on the lowermost shelf board 3-n. The water-supply member 9 is provided with a water-supply nozzle 10 from which the water is poured into each of the frames 6 mounted on the shelf boards 3 when each of the shelf boards 3 reaches the above position "A". In this first embodiment of the present invention, the water-supply member 9 is fixed to a certain position in the casing 1. However, it is also possible to permit the water-supply member 9 to vertically move, provided that the shelf boards 3 are fixed to certain positions in which the shelf boards 3 may tilt.

The above first embodiment of the present invention operates as follows.

When the shelf board 3 carrying the frame 6 thereon reaches the predetermined position "A", such shelf board 3 is kept at a temperature below 0° C. After that, a valve of the water-supply member 9 is opened to spray predetermined two areas with a predetermined amount of water, which two areas consist of: the refrigerating-/heating surface 5 of the shelf board 3 encircled with the frame 6; and an area defined between such refrigerating/heating surface 5 and a lower end of the frame 6 mounted on the surface 5. As a result, the thus supplied water is immediately frozen to form an ice film with which the above two areas are coated. Under such conditions, the shelf board 3 remains cooled to a temperature below 0° C. In case that a material to be dried is a liquid, such liquid material to be dried is poured into the frame 6 mounted on the above shelf board 3 by means of a fixed-displacement syringe means (not shown). At this time, in quality assurance of the dried material or product, it is preferable to previously cool such liquid material to the lowest temperature near its freezing point, at which lowest temperature the liquid material is still not frozen. However, even when the liquid material to be dried is kept at room temperature in its pouring operation, there is no problem in quality assurance, provided that both the ice film and the above two areas, i.e., the refrigerating/heating surface 5 of the shelf board 3 and the area defined between such surface 5 and the lower end of the frame 6 are sufficiently cooled. The thus poured liquid material horizontally spreads, provided that its pouring speed is not extremely low. On the other hand, in case that the material to be dried is a flat solid material such as a sliced meat, such a plurality of the solid material pieces are uniformly and horizontally arranged in the frame 6 mounted on the shelf board 3 so as to be frozen on the refrigerating/heating surface 5 of the shelf board 3. At this time, the material pieces are prevented from being supercooled by the presence of the ice film and uniform heat transfer established between the material pieces and the refrigerating/heating surface 5 of the shelf board 3. As a result, in any of the material pieces to be dried, there grow ice crystals having uniform upright needle-like shapes so that the material pieces freeze. At this time, since there is no air gap constituting a considerable resistance in heat transfer between the material pieces and the refrigerating/heating surface of the shelf board 3, it is possible to control a growing speed of the ice crystal by precisely controlling the temperature of the shelf board 3 on which the material pieces to be dried are disposed. Namely, it is possible to control the ice crystals in diameter. After completion of freezing of the material pieces, a necessary vacuum is produced in the drying chamber 2. Under such conditions, the temperature of the shelf board 3 is controlled to dry the frozen material pieces. In the beginning of the drying operation of the material pieces conducted on the refrigerating/heating surface 5 of the shelf board 3, the material pieces are brought into a close contact with the refrigerating/heating surface 5 of the shelf board 3 through the ice film. Consequently, the temperature of the shelf board 3 should be kept at a level permitting the material pieces to obtain from the refrigerating/heating surface 5 the heat required for sublimation of at least one of constituents of each of the material pieces. Generally, when an amount of from 50 to 60% of each of the material pieces has been dried (though this percentage varies, depending on properties of the material to be dried and the drying conditions), sublimation of the ice film occurs since vapors escape from cracks of the material being dried, which cracks are produced during the freezing operation of the material. As a result, the ice film is eliminated through sublimation thereof to facilitate sublimation of the material being dried since additional sublimation of the material occurs also in a bottom portion of the material. From the beginning of such additional sublimation, the temperature of the shelf board 3 is grauduary rised to enhance these sublimations. After completion of the sublimations, clean air or nitrogen gas is introduced into the drying chamber 2 to cancel the vacuum therein. After that, the door means (not shown) of the drying chamber 2 is opened, and then a dried material or product receiver 11 is sequentially brought into contact with each of the shelf boards 3. When the product receiver 11 abuts against the shelf board 3, the frame 6 mounted on such shelf board 3 is pulled forward to collect the dried material or product in the product receiver 11. At this time, as described in the above, in most cases, since the dried material or product has many cracks and is contracted in volume in the frame 6, the dried material or product is split into small fragments during the collecting operation of the product. After completion of such collecting operation, the frame 6 is slidably returned to its initial position or temporarily taken out of the drying chamber 2. In the above first embodiment of the present invention, the ice film is formed by spraying the above-mentioned two areas such as the refrigerating/heating surface 5 and the like having a temperature below 0° C. with water. However, it is also possible to form the ice film by forming a water film to cover the above-mentioned areas at first and then freezing the thus formed water film.

Figure 3:
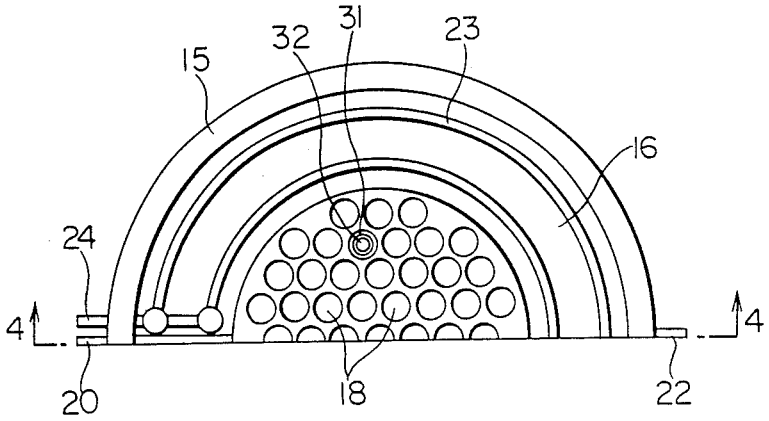
FIG. 3 is a cross-sectional view of a rear half of a second embodiment of the freeze-drying apparatus of the present invention, taken along the line 3—3 of FIG. 4.
Figure 4:
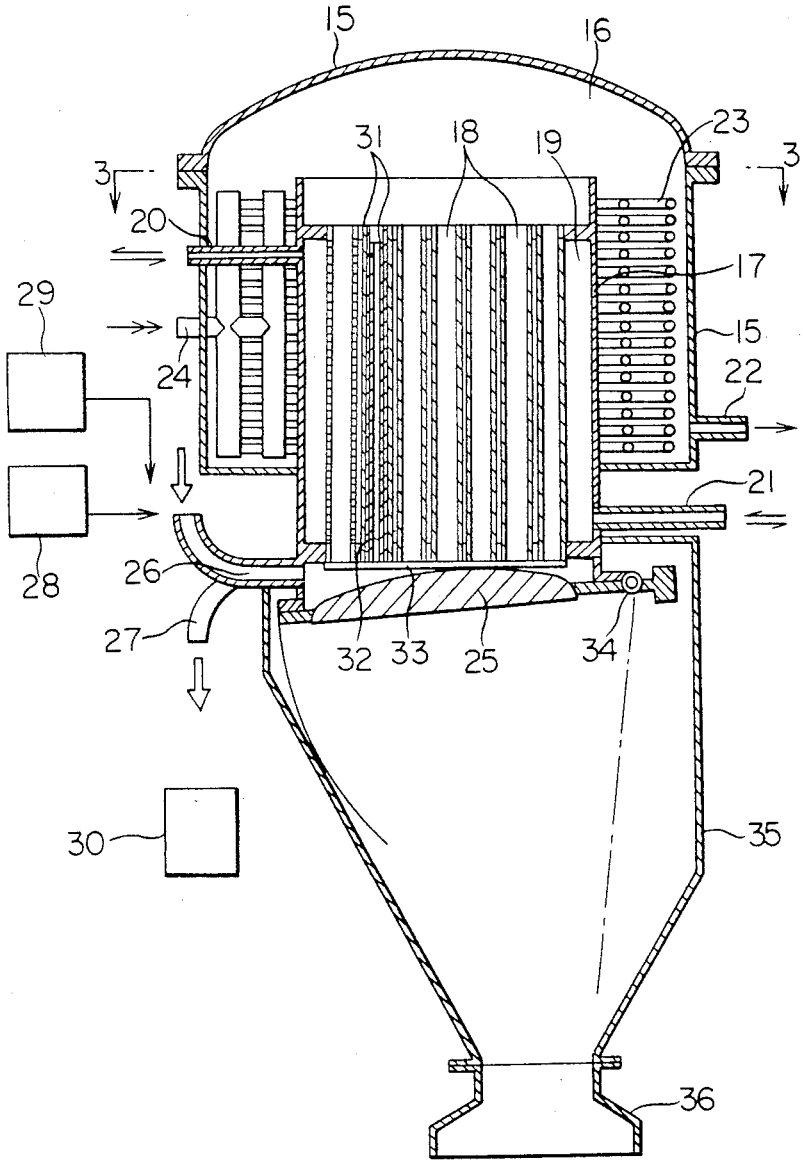
FIG. 4 is a longitudinal sectional view of the second embodiment of the freeze-drying apparatus of the present invention, taken along the line 4—4 of FIG. 3.

FIGS. 3 and 4 show a second embodiment of the present invention, in which: the reference numeral 15 denotes a casing of a drying chamber 16 in which is provided with a heat-transfer medium container 17 having a side wall which are provided with a pair of pipelines 20, 21 through which a heat-transfer medium is circulated. The container 17 is also provided with an upper and a lower end plates between which is fixedly mounted a refrigerating/heating member 18 constructed of a plurality of tubes. The refrigerating/heating member 18 is encircled with a peripheral space 19. The drying chamber 16 is connected with a vacuum pump (not shown) through a suction pipe 22. The heat-transfer medium container 17 is encircled with a vapor trap 23 having a coil-like shape. The vapor trap 23 is connected with a feed pipe 24 through which the heat-transfer medium or refrigerant flows into the vapor trap 23 so as to be circulated therethrough. The refrigerating/heating member 18 can be constructed of a single tube.

The heat-transfer medium container 17 is provided with a lower-end opening which is opened/closed hermetically by means of a lower end lid 25 swingably fitted on a lower end portion of the container 17 as shown in FIG. 4. In a side wall of a lower portion of the container 17 are provided a liquid feed pipe 26 and a liquid discharge pipe 27. The liquid feed pipe 26 is alternatively connected with a water supply tank 28 and a liquid supply tank 29. The liquid discharge pipe 27 guides a liquid being discharged to a liquid discharge tank 30.

The second embodiment of the present invention having the above construction operates as follows.

At first, the heat-transfer medium having been cooled to a temperature below 0° C. is supplied through the pipelines 20 and 21 to the peripheral space 19 defined between the refrigerating/heating member 18 and the heat-transfer medium container 17 having a cylindrical shape, and circulated through the peripheral space 19 and these pipelines 20, 21. Then, water is supplied from the water supply tank 28 through the liquid feed pipe 26 to the refrigerating/heating member 18 until a level of the water having been received in the member 18 reaches a position in the vicinity of an upper end of the member 18. The thus received water is brought in contact with an inner wall of the refrigerating/heating member 18 and begins freezing to form a ice film 31 covering the inner wall of the member 18 as shown in FIG. 4. When the thickness of the ice film 31 reaches an amount of less than 1 mm, preferably an amount of 0.5 mm, the water received in the refrigerating/heating member 18 is discharged from the member 18 through the liquid discharge pipe 27.

In this case, when the refrigerating/heating member 18 is too cooled, the water received therein freezes too rapidly. As a result, the thickness of the ice film 31 formed in a lower portion of the member 18 becomes too thick, because the water residing in the lower portion of the member 18 stays in the member 18 for a period of time longer than that of the water residing in the other portion of the member 18 until the water is discharged from the member 18. In order to prevent the thickness of the ice film 31 from becoming too thick, the refrigerating/heating member 18 is cooled to a temperature of from −10° to −15° C. before the water is supplied to the refrigerating/heating member 18 through the liquid feed pipe 26. As a result, the thus formed ice film 31 can keep its thickness constant and its volume small.

After completion of formation of the ice film 31 covering the inner wall of the refrigerating/heating member 18, the member 18 is sufficiently cooled. Then, a liquid material, which has been received in the liquid supply tank 29 and cooled to a temperature around its freezing point in the tank 29, is poured into the refrigerating/heating member 18 until a level of the liquid material thus poured in the member 18 reaches a position slightly below the level of the ice film 31. As a result, a frozen layer 32 of the liquid material is uniformly formed on the ice film 31 so as to substantially cover the ice film 31 as shown in FIG. 4. Namely, the frozen layer 32 of the liquid material grows radially inwardly toward a central axis of each of the tubes constituting the refrigerating/heating member 18. When the frozen layer 32 of the liquid material has a desired thickness for permitting each of the tubes constituting the member 18 to have a central passage required to effect the freeze drying operation of the liquid material, the liquid material still not frozen is discharged through such central passages and the liquid discharge pipe 27 into the liquid discharge tank 30. In this second embodiment of the present invention, the liquid feed pipe 26 also serves as a water feed pipe and the liquid discharge pipe 27 also serves as a water discharge pipe. However, it is also possible to separately provide the water feed pipe and the water discharge pipe. Since the liquid material residing in a boundary area between the frozen layer 32 of the liquid material and the remaining portion of the same still not frozen is naturally cooled to the freezing point of the liquid material, the liquid material collected in the liquid discharge tank 30 has a temperature substantially equal to that of the liquid material received in the liquid supply tank 29. The liquid material collected in the liquid discharge tank 30 is returned to the liquid supply tank 29 so as to be repeatedly employed in the following cycle of the freeze drying operation. However, as described later, in case that a plurality of the drying chambers are employed in parallel in the freeze drying operation of the liquid material, it is possible to return the thus collected liquid material to a liquid supply tank connected with another drying chamber employed in the following cycle. In this case, it is also possible to provide a single common liquid supply tank connected with the plurality of the drying chambers.

In operation, after any of valves provided in the pipes for transmitting the water and the liquid material is closed, the heat-transfer medium or refrigerant having a temperature of from −40° to −70° C. is supplied to the trap 23 so that the cooling operation is conducted, while a necessary vacuum is produced in the drying chamber 16 by means of the vacuum pump (not shown) so that the refrigerating/heating member 18 is subjected to the vacuum environment. As this time, the heat-transfer medium is supplied to the peripheral space 19 defined between the refrigerating/heating member 18 and the heat-transfer medium container 17 through the pipelines 20, 21 so as to supply the heat required to effect the freeze drying operation of the frozen layer 32 of the liquid material to the ice film 31 and the frozen layer 32 of the liquid material to the extent that the heat does not melt any of the ice film 31 and the frozen layer 32 of the liquid material.

In the beginning of the freeze drying operation, the frozen layer 32 of the liquid material adheres to the ice film 31 covering the inner wall of the refrigerating/heating member 18 so that sublimation occurs in a free surface of the frozen layer 32 of the liquid material, which free surface encircles the central axis of each of the tubes constituting the member 18. Under such circumstances, the ice film 31 eventually disappears through sublimation of itself to permit the frozen layer 32 of the liquid material to separate from the inner wall of the refrigerating/heating member 18. In order to prevent the thus separated frozen layer 32 of the liquid material from dropping out of the inner surface of the member 18, the lower end lid 25 has a supporting member 33 at its back surface for supporting such separated frozen layer 32. In the second embodiment of the present invention shown in FIG. 4, the supporting member 33 is constructed of a wire net or a rod assembly.

After completion of the freeze drying operation, clean air or nitrogen gas is admitted to the drying chamber 16 so that the inside pressure of the drying chamber 16 becomes equal to the atmospheric pressure. After that, the lower end lid 25, which is swingably connected to the lower end portion of the drying chamber 16 through a hinge 34, is swung open downward to permit the above-mentioned separated frozen layer 32 of the liquid material, i.e., dried product 32 held in the drying chamber to drop into an upper product receiver 35, so that collecting operation of the product 32 is conducted. During the collecting operation, the flow rate of the product 32 gravity-drops as the lower end lid opens. The product 32 received in the upper product receiver 35 further drops into a lower product receiver 36 connected to a lower end portion of the upper product receiver 35. Since the product 32 having been freeze-dried to have a cylindrical shape is very brittle, such cylindrical product 32 is broken to small pieces having a size of several of centimeters when subjected to impacts during the collecting operation thereof. Naturally, a small amount of fine powder of the product 32 is also produced when the cylindrical product 32 is broken in the product receiver 35. Such fine powder tends to remain to the slope of the product receiver 35. However, since the product receiver 35 is completely shut off from the drying chamber 16 during the freeze drying operation of the liquid material, there is no fear that such fine powder adhering to the slope of the product receiver 35 enters the drying chamber 16 to contaminate the liquid material introduced into the drying chamber 16 in the following cycle of the freeze drying operation, and, therefore, there is no fear that the fine powder deteriorates the quality of the product 32.

Figure 5:
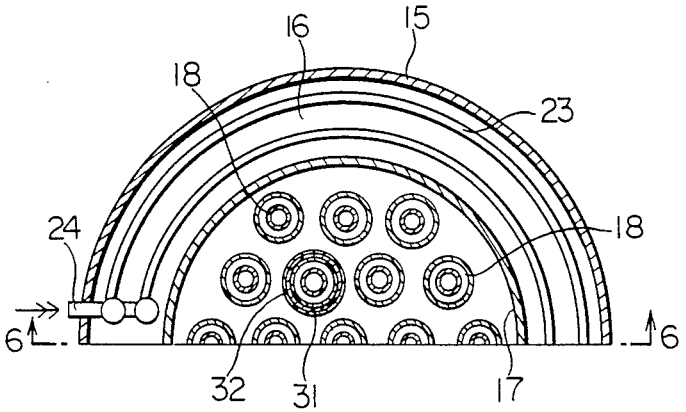
FIG. 5 is a cross-sectional view of a rear half of a third embodiment of the freeze-drying apparatus of the present invention, taken along the line 5—5 of FIG. 6.
Figure 6:
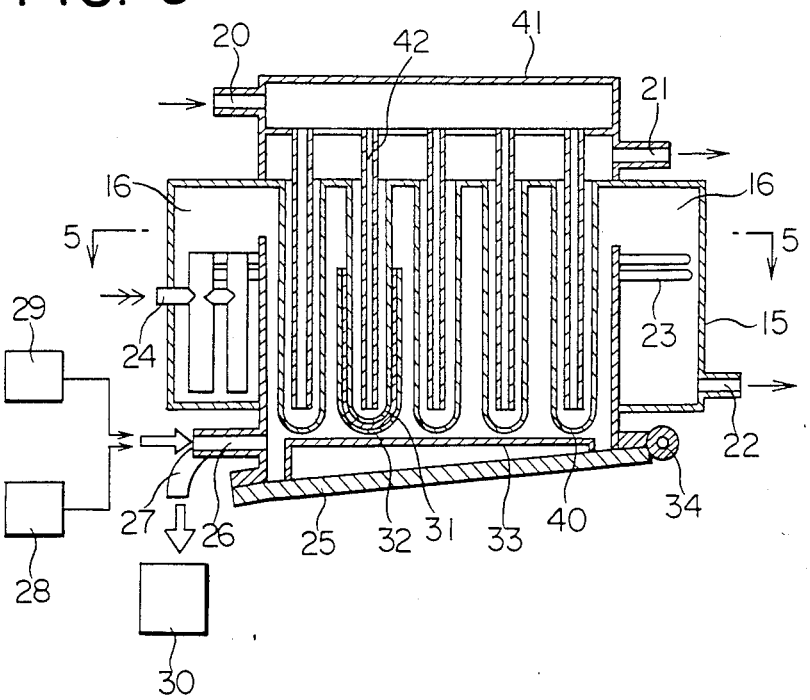
FIG. 6 is a longitudinal sectional view of the third embodiment of the freeze-drying apparatus of the present invention, taken along the line 6—6 of FIG. 5.

FIGS. 5 and 6 show a third embodiment of the present invention, which is a modified example of the above second embodiment of the present invention, and, therefore, between the second embodiment and the third embodiment there is a slight difference in construction but nevertheless substantially no difference in function therebetween. In FIGS. 5 and 6, the same reference numerals are used as in FIGS. 3 and 4 to indicate like parts.

The third embodiment of the present invention differs from the second embodiment of the present invention in construction as follows:

In the third embodiment of the present invention, a refrigerating/heating member 40 on which are formed the ice film 31 and the frozen layer 32 of the liquid material is provided in the drying chamber 15, but not provided in the heat-transfer medium container 41 (which is denoted by the reference numeral 17 in the second embodiment as shown in FIG. 4). In addition, in contrast with the refrigerating/heating member 18 of the second embodiment of the present invention shown in FIG. 4, the refrigerating/heating member 40 of the third embodiment of the present invention has a closed bottom. As shown in FIG. 6. the heat-transfer medium container 41 of the third embodiment is mounted on the drying chamber 15 while provided with a plurality of heat-transfer medium supply tubes 42. Each of the tubes 42 is spaced apart from each other and inserted into the refrigerating/heating member 40 to form a double-wall tube.

In operation, there is substantially no difference between the third embodiment of the present invention and the second embodiment of the present invention except that: in the third embodiment of the present invention, the ice film 31 and the frozen layer 32 of the liquid material are formed on an outer peripheral surface of the refrigerating/heating member 40 since water and the liquid material are supplied to a space outside the refrigerating/heating member 40.

In the third and the second embodiments of the present invention, the liquid material is supplied to the surfaces of the refrigerating/heating members 18, 40 from the liquid supply tank 29 and partially returned to the tank 29 so as to be sequentially used in the following cycles of the freeze drying operation of the liquid material.

Consequently, the third and the second embodiments of the present invention are suitable for continuous production of a single kind of product. Namely, in these embodiments of the present invention, the liquid material is partially circulated while always kept in sealed tanks and pipes at temperature near to its freezing point, which temperature is the lowest one at which the liquid material is still not frozen so that the proliferation of bacteria is halted. Incidentally, in contrast with the third and the second embodiments of the present invention, the first embodiment of the present invention shown in FIGS. 1 and 2 is suitable for batch-type small-quantity production of various kinds of products, since the first embodiment of the present invention makes it possible to change the liquid material in kind in each cycle of the freeze drying operation without causing any trouble.

Figure 7:
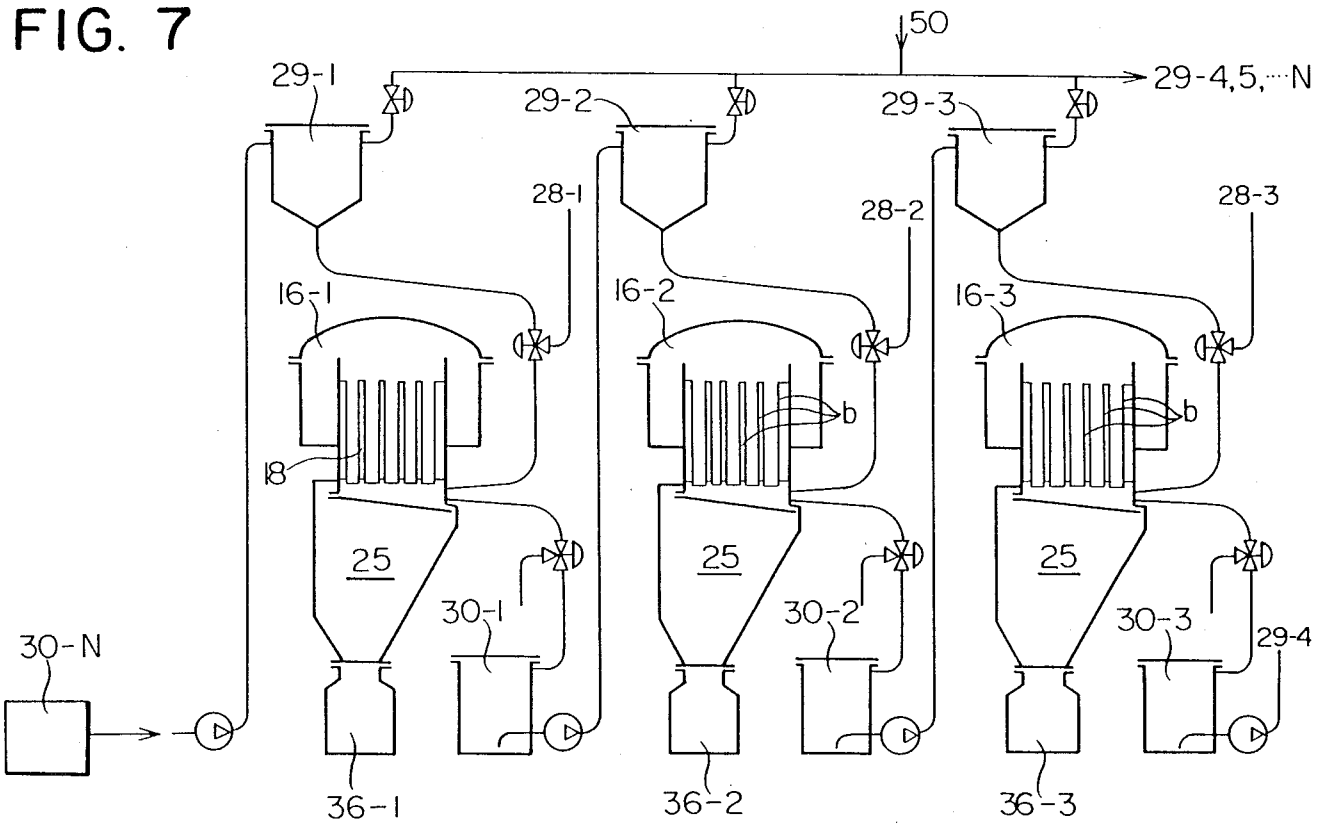
FIG. 7 is a partly schematic, partly diagrammatic illustration of a freeze-drying plant comprising in combination a plurality of the freeze-drying apparatuses of the present invention.

FIG. 7 shows a freeze-drying plant constructed of a plurality of the second embodiment of the present invention for reducing a dwell time of the liquid material in the drying chamber 16 by canceling a large-capacity drying chamber 16 which is replaced with a plurality of small-capacity drying chambers 16-1 to 16-n. The whole number of the small-capacity drying chambers are "n". As is in the case of the shelf boards 3 employed in the first embodiment of the present invention shown in FIGS. 1 and 2: in FIG. 7, each of the reference numerals 16, 28, 29, 30 and 36 varies. For example, as for the drying chamber 16, the reference numeral 16 varies from the 16-1 to the 16-n, and the reference numeral 16-1 denotes the first drying chamber, while the reference numeral 16-n denotes the n'th drying chamber.

In operation, as shown in FIG. 7, the liquid material returned to the first liquid discharge tank 30-1 is supplied to the second liquid supply tank 29-2. In case the plant shown in FIG. 7 is constructed of six units of the drying chambers 6, a time required to complete one cycle of the freeze drying operation is twelve hours. At this time, the ratio of an amount of the liquid material having a dwell time of twelve hours in the drying chamber 16 to the total amount of the product 32 is only 2/100, i.e., 2%, provided that a 52% of the liquid material supplied to the refrigerating/heating member 18 is returned to the liquid discharge tank 30.

In the plant shown in FIG. 7, the units of the drying chambers 16 are sequentially operated at predetermined-time intervals. At first, the liquid material is supplied to the plant from a common source 50 of its supply, and then a predetermined amount of the liquid material is supplied to the first liquid supply tank 29-1. After that, another predetermined amount of the liquid material is supplied to the second liquid supply tank 29-2. In this manner, the predetermined amount of the liquid material is supplied to all the liquid supply tanks 29 employed in the plant.

On the other hand, a predetermined amount of water is supplied to the refrigerating/heating member 18 of the first drying chamber 16-1 from the water supply tank 28-1 to form ice film 31 on the surface of the refrigerating/heating member 18 of the first drying chamber 16-1, and then the remaining part of the water not frozen is discharged from the first drying chamber 16-1. After that, the liquid material received in the first liquid supply tank 29-1 is supplied to the first drying chamber 16-1 to form the predetermined thickness frozen layer 32 of the liquid material on the ice film 31 covering the refrigerating/heating member 18 of the first drying chamber 16-1, and then the remaining part of the liquid material still not frozen is discharged from the first drying chamber 16-1 to the first liquid discharge tank 30-1. Such remaining part of the liquid material received in the first liquid discharge tank 30-1 is then supplied to the second liquid supply tank 29-2 in two hours' time by means of a pump (not shown), and mixed with the liquid material supplied from the common source 50 of the liquid material. In this manner, the liquid material is partially circulated through the plant shown in FIG. 7, so that the remaining part of the liquid material received in the n'th liquid discharge tank 30-N is returned to the first liquid supply tank 29-1. As a result, it is possible to sequentially collect the product or dried material 32 at two-hour intervals from the product receivers 36-1, 36-2, . . . , 36-N of the plant shown in FIG. 7 in twelve hours' time after the plant is operated.

In the plant shown in FIG. 7, it is possible to employ common liquid supply tank or tanks, common liquid discharge tank or tanks and common pump or pumps, and the whole numbers of these common units can vary as required. Namely, in the plant, it is possible to employ these common units the whole numbers of each of which units is less than that of the drying chambers 16 employed in the plant.

Figure 8:
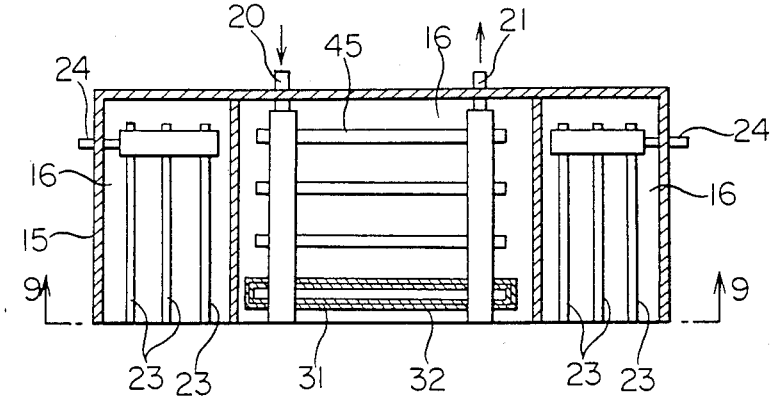
FIG. 8 is a cross-sectional view of a rear half of a fourth embodiment of the freeze-drying apparatus of the present invention, taken along the line 8—8 of FIG. 9.
Figure 9:
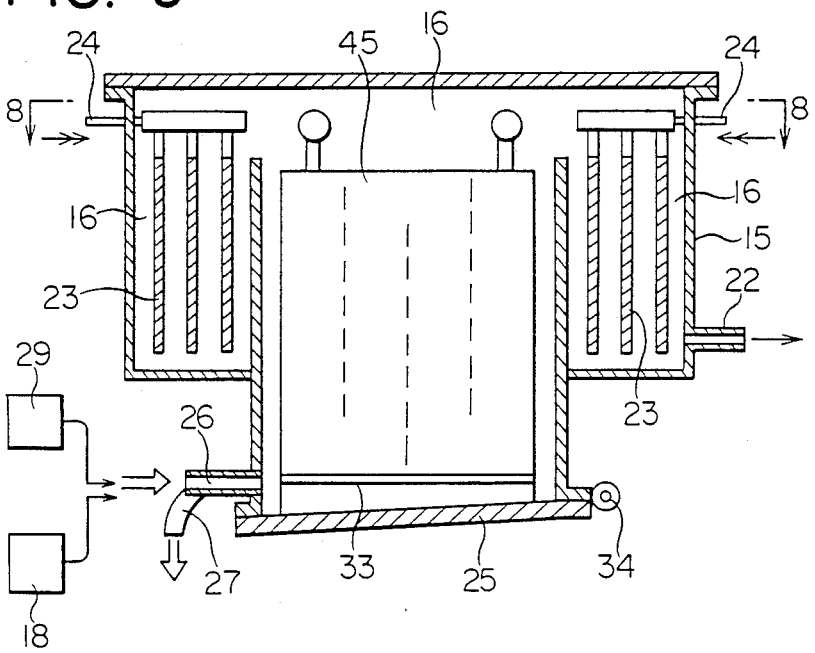
FIG. 9 is a longitudinal sectional view of the fourth embodiment of the freeze-drying apparatus of the present invention, taken along the line 9—9 of FIG. 8.

FIGS. 8 and 9 show a fourth embodiment of the present invention, which is a further another modified example of the second embodiment and the third embodiment of the present invention. Consequently, in FIGS. 8 and 9, the same reference numerals are used as in FIGS. 3 to 7 to indicate like parts, so that difference in construction between the previous (the second and the third) embodiments of the present invention and the fourth embodiment of the present invention will described hereinbelow.

The fourth embodiment of the present invention differs from the second and the third embodiments of the present invention only in construction in the following one point: namely, in contrast with the second and the third embodiments, in the fourth embodiment, a refrigerating/heating member 45 is constructed of flat boxes but not constructed of tubes. Consequently, the fourth embodiment of the present invention is operated in the same manner as that of the second embodiment of the present invention.

As is clear from the above description of the preferred embodiments, the present invention has the following advantages:

(1) In contrast with the prior tray/shelf system, the containers such as trays and the like for receiving the material to be dried are not required in the present invention. Namely, according to the present invention, the material to be dried is directly supplied onto the refrigerating/heating surface provided in the drying chamber of the present invention. After completion of the freezing and drying operation of the material to be dried, since the thus dried material is directly collected from the drying chamber of the present invention, the present invention makes it possible to eliminate conventional mechanisms required to handle and to clean the containers, which leads to eliminate the space for such mechanisms. These eliminations save the apparatus of the present invention much space;

(2) The material to be dried is brought into a direct contact with the refrigerating/heating surface through the ice film so that there is no fear of uneven freezing of the material to be dried. Incidentally, in case that the refrigerating/heating surface is cooled through circulation of the heat-transfer medium, a heat-transfer coefficient between the heat-transfer medium and the refrigerating/heating surface is within a range of from 600 to 700 $Kcal/m^2 \cdot h \cdot °C.$ and stable, while that between the container and the refrigerating/heating surface in the tray/shelf system is substantially within a range of from 60 to 70 $Kcal/m^2 \cdot h \cdot °C.$ and unstable. Consequently, the heat transfer between the heat-transfer medium and the material to be dried in the tray/shelf system is largely affected by the latter coefficient of 60 to 70 $Kcal/m^2 \cdot h \cdot °C.$, i.e., the heat is transferred from the heat-transfer medium to the material at a rate of 60 $Kcal/m^2 \cdot h \cdot °C.$, on the average. On the other hand, in the present invention, in case that the ice film has a thickness of 0.5 mm, the heat transfers from the refrigerating/heating surface to the material at a rate of about 400 $Kcal/m^2 \cdot h \cdot °C.$ in a stable manner. Therefore, the material to be dried can freeze in the embodiments of the present invention several times faster than in the tray/shelf system;

(3) Since the material to be dried begins to be uniformly frozen on the ice film without being supercooled, the needle-like ice crystals grow in the material uniformly in a direction perpendicular to an initial frozen surface of the material so as to form the frozen layer of the material. Such formation of the needle-like ice crystals is advantageous to both the heat transfer and an escape of vapor which facilitate the freeze drying operation of the material uniformly. Incidentally, in case that the material to be dried contains no ice crystal in it, it is not possible to freeze the material at its freezing point. As a result, the material is supercooled, and then water contained in the material is sudden crystallized into a form of isolated fine crystals which form a frozen deposit layer on the refrigerating/heating surface. Since such frozen deposit layer tends to melt during the freeze drying operation of the material, and, therefore, to prevent the material from being uniformly dried;

(4) Even when the ice film 31 formed on the surface of the refrigerating/heating member is a considerably thin film having a thickness of approximately 0.5 mm, such thickness is sufficiently larger than a size of pore of the dried porous layer 32, which pores size is within a range of from 0.1 to 0.01 mm. Consequently, sublimation of the ice film 31 on the surface of the refrigerating/heating member occurs through the cracks formed in the material being dried in the freeze drying operation of the material. After completion of the sublimation of the ice film 31, sublimation of at least one of the constituents of the material being dried occurs in opposite sides of the material to enhance the freeze drying operation of the material, and to prevent the frozen layer 32 of the material from melting in the freeze drying operation of the material;

(5) In case that the container for receiving the material being dried is required to conduct the freeze drying operation of the material, the above-mentioned advantages (1) and (2) disappear. However, the other advantages (3) and (4) mentioned above can be obtained when the ice film is formed in an inner surface of the container. In addition, in this case, the ice film formed in the inner surface of the container makes it easy to collect the dried material or product from the container, and also eliminates the necessity of container cleaning after completion of each cycle of the freeze drying operation.

Incidentally, the present invention involves an additional load of the ice film in its formation and sublimation. However, such additional load is less than an amount of from 5 to 10% of a load of the freeze drying operation of the material being dried, since a water content of the material per square meter is at least 10 $Kg/m^2$ whereas that of the ice film is about 0.5 $Kg/m^2$. Consequently, the above additional load substantially constitute any demerit, because the above-mentioned advantage (2) of the present invention considerably save energy.

In addition, the second, third and fourth embodiments of the present invention have also the following advantages in addition to the above advantages (1) to (5);

(6) According to the present invention, the material to be dried is completely treated at a temperature below 0° C. in a hermetically closed apparatus during its freeze drying operation which is conducted only by a simple operation comprising, in combination: an opening/closing operation of automatic valves provided in the pipelines; a starting/stopping operation of the pumps; and an opening/closing operation of the lower end lid swingably connected to the lower end portion of the drying chamber. In addition, such hermetically closed apparatus of the present invention does not contain any other movable components except the above components, i.e., the automatic valves, pumps and the lower end lid. Consequently, the present invention can realize a high-level hygienic environment in treatment of the material being dried;

(7) According to the present invention, it is possible to remove any movable components from the vacuum chamber or drying chamber of the present invention. In addition, the material to be dried is automatically supplied to the drying chamber through the operations of the automatic valves and pumps provided in the pipelines for transmitting the material being dried, and then the thus dried material or product is also automatically collected to the product receiver through the operation of the lower end lid; and (8) After formation of the frozen layer 32 of the liquid material being dried, the remaining part of the liquid material still not frozen is drained from the drying chamber. As a result, the front portions of the needle-like crystals of the frozen layer 32 of the material is substantially subjected to the vacuum environment during the freeze drying operation without being covered with a concentrated amorphous film or eutectic-state film of the liquid material. In other words, since a condensed concentrated amorphous film covering the frozen layer 32 of the liquid material is extremely thin in the present invention, vapor can easily escape from the surface of the frozen layer of the material to enhance sublimation of the frozen layer 32.

Hitherto, in order to remove such concentrated film of the liquid material from the surface of the frozen layer 32: a nylon gauze is applied to the surface of the liquid material, which gauze is removed from the surface of the frozen layer 32 after the liquid material is frozen; or the surface of the frozen layer 32 is sprayed with a water having supercooled or having a temperature of up to 0° C. so as to dilute a concentration of the concentrated film covering the surface of the frozen layer 31 of the liquid material. After that, the thus obtained frozen layer of the material is broken to have a particle size of from 1 to 3 mm, and then received in the containers such as trays employed in the freeze drying operation. The concentrated film of the liquid material covering the surface of the frozen layer 31 of the material prevents sublimation of the frozen layer 31 of the material from smoothly occurring. In addition, it is not possible to prevent a sudden breakage of the concentrated film of the material, which leads to deterioration of the quality of the dried material or product. These disadvantages are overcome by the present invention.

Since the second, third and fourth embodiments of the present invention have the above-mentioned advantages, it is possible to employ them in production of concentrated liquid material having a high quality. Such production is accomplished by interrupting the freeze drying operation of the liquid material before sublimation of the frozen layer 31 is completed. In concentration through evaporation, the volatile matter contained in the liquid material escapes faster than vapor of its water content from the liquid material, so that the liquid material loses the volatile matter much more than its water content in its condensation through evaporation. However, in sublimation conducted during the freeze drying operation, since the volatile matter contained in the liquid material is absorbed in a concentrated liquid-phase part of the liquid material, there is substantially no loss of the volatile matter contained in the liquid material. After completion of sublimation, a dried porous material or product is obtained, which is subjected to a drying operation during which a part of the volatile matter is lost together with the water content. The above is a known technique employed in a partial freeze drying operation for concentrating the liquid material. This technique is, however, disadvantageous in: first, in involving a complex handling of the trays; and second, in formation of the heterogeneous ice crystals of the liquid material during its freezing operation, which crystals prevents the drying operation of the frozen material from being smoothly conducted and causes a partially excessive drying operation through which the volatile matter contained in the material is considerably lost. Such loss of the volatile matter deteriorates the quality of the dried material or product. These disadvantages are overcome by the present invention.

Although the preferred embodiments of the present invention have been disclosed in detail for illustration purposes, it will be recognized that variations or modifications of the disclosed embodiments, including the rearrangement of components thereof, lie within the scope of the present invention.

What is claimed is:

1. A method for freeze drying, comprising the steps of: supplying a predetermined amount of water onto a refrigerating/heating surface provided inside a drying chamber of a vacuum-type freeze drying apparatus, said refrigerating/heating surface being cooled to a temperature below 0° C. to form an ice film having a predetermined thickness thereon; keeping said refrigerating-/heating surface at a temperature below 0° C.; under such conditions, supplying a material to be dried onto a surface of said ice film to cause said material to freeze on said ice film; and producing a vacuum in said drying chamber of said vacuum-type freeze drying apparatus, whereby sublimation of said ice film and said material frozen thereon occurs.

2. A freeze drying apparatus comprising: a drying chamber in which a vacuum is produced; a refrigerating/heating means vertically provided in said drying chamber, said refrigerating/heating means being provided with an inner and an outer surfaces one of which constitutes a refrigerating/heating surfaces and the other of which constitutes a back surface of said refrigerating/heating surface; a heat-transfer medium supply means for supplying a heat transfer medium to said back surface of said refrigerating/heating means; a water supply/discharge means for substantially uniformly supplying a predetermined amount of water to said refrigerating/heating surface of said refrigerating-/heating means and for discharging the water from said drying chamber; a liquid supply/discharge means for supplying a liquid material being dried to an ice film formed on said refrigerating/heating surface of said refrigerating/heating means; and a lid mounted on a lower end portion of said drying chamber.

3. The freeze drying apparatus as set forth in claim 2, wherein: said drying chamber contains a heat-transfer medium container provided with a heat-transfer medium supply/discharge portion; said refrigerating/heating means is constructed of a hollow tube provided in said heat-transfer medium container, said hollow tube having an upper and a lower opening portions which open into said drying chamber, said hollow tube further having an inner peripheral surface constituting said refrigerating/heating surface.

4. The freeze drying apparatus as set forth in claim 2, wherein: a heat-transfer medium container provided with a heat-transfer medium supply/discharge portion is mounted on an upper portion of said drying chamber; said refrigerating/heating means is constructed of a hollow tube provided with an upper opening portion which communicates with a heat-transfer medium discharge portion of said heat-transfer medium container, said hollow tube having a closed bottom and an outer peripheral surface which constitutes said refrigerating-/heating surface; and a heat-transfer medium supply tube having an open bottom is inserted into said hollow tube to form a doubled-wall tube, said heat-transfer medium supply tube making its upper portion communicate with a heat-transfer supply portion of said heat-transfer medium container.

5. The freeze drying apparatus as set forth in claim 2, wherein: said refrigerating/heating means is constructed of a flat box an outer peripheral surface of which constitutes said refrigerating/heating surface.

6. The freeze drying apparatus as set forth in claim 2, wherein: said liquid supply/discharge means and a pipeline connecting the same with said refrigerating/heating means are cooled so that said liquid material being dried is kept at a temperature around 0° C. preferably up to 0° C.

* * * * *